US006701098B2

(12) United States Patent
Pyke et al.

(10) Patent No.: US 6,701,098 B2
(45) Date of Patent: Mar. 2, 2004

(54) AUTOMATICALLY DETERMINING HEAT-CONDUCTIVE PROPERTIES OF PRINT MEDIA

(75) Inventors: Neil R. Pyke, Boise, ID (US); Jamison B. Slippy, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 107 days.

(21) Appl. No.: 10/081,487

(22) Filed: Feb. 20, 2002

(65) Prior Publication Data

US 2003/0156849 A1 Aug. 21, 2003

(51) Int. Cl.[7] ..... G03G 15/00; B65H 29/70

(52) U.S. Cl. ..... 399/45; 271/161; 271/188; 271/209

(58) Field of Search ..... 399/45; 271/265.04, 271/262, 263, 209, 161, 188

(56) References Cited

U.S. PATENT DOCUMENTS

| | | | | | |
|---|---|---|---|---|---|
| 4,634,262 | A | * | 1/1987 | Imaizumi et al. | 399/45 |
| 4,958,522 | A | | 9/1990 | McKinlay | |
| 5,073,801 | A | * | 12/1991 | Haneda et al. | 399/45 |
| 5,201,424 | A | * | 4/1993 | Hain | 271/188 |
| 5,405,205 | A | | 4/1995 | Venthem et al. | |
| 5,512,992 | A | * | 4/1996 | Kim et al. | 399/45 |
| 5,609,334 | A | * | 3/1997 | Silveira et al. | 271/188 |
| 5,743,521 | A | * | 4/1998 | Munakata et al. | 271/263 |
| 5,865,121 | A | | 2/1999 | Testardi et al. | |
| 5,967,511 | A | | 10/1999 | Bell | 271/252 |
| 6,189,879 | B1 | * | 2/2001 | Conner et al. | 271/263 |
| 6,201,937 | B1 | | 3/2001 | Folkins | 399/49 |
| 6,381,422 | B1 | * | 4/2002 | Tanaka | 399/45 |
| 6,381,423 | B1 | * | 4/2002 | Eom | 399/45 |
| 2003/0044189 | A1 | * | 3/2003 | Okitsu et al. | 399/45 |

* cited by examiner

*Primary Examiner*—Susan S. Y. Lee

(57) ABSTRACT

An implementation of a technology is described herein for automatically determining the heat-conductive properties of print media. More particularly, described herein is a technology for indirectly and automatically determining the heat-conductive properties of print media by determining the stiffness of print media, such as acetate and paper. At least one embodiment, described herein, includes a registration assembly of a laser printer. In this assembly, the print medium is deflected (i.e., bent, bowed, buckled, etc.). A measurement of such deflection is made. That measurement is an indication of the relative stiffness of the print medium. Assuming approximately similar densities, the stiffness of print media is directly related to its thickness. The thicker the medium the stiffer it is and vice versa. The thickness of print media is directly related to its heat conductivity.

15 Claims, 3 Drawing Sheets registration assembly of a laser printer

AUTOMATICALLY DETERMINING HEAT-CONDUCTIVE PROPERTIES OF PRINT MEDIA

TECHNICAL FIELD

This invention generally relates to a technology for automatically determining the heat-conductive properties of print media.

BACKGROUND

Laser printers (such as the one shown at 100 in FIG. 1) and copiers are common examples of electrophotographic production devices. In general, the art of electrophotographic production devices (EPD) is well known. The focus, herein, is on one component of EPDs: the registration assembly, Traditionally, the role of the registration assembly is to deskew (i.e., straight) the print medium before an image is printed on it.

The following U.S. patents include a general description of an EPD and/or the role of the registration assembly of such a device: U.S. Pat. Nos. 5,865,121; 6,201,937; and 5,967,511.

Herein, references to laser printers (like printer 100 in FIG. 1) expressly include all EPDs. Also, references to print media, herein, generally refers to paper on which images are printed, but it may include other substrates, such as acetate.

Registration Assembly

Just before the print medium passes through the imaging area, the printer stops the medium at an internal portion of the printer called the "registration assembly." In the registration assembly, a movable "stop" pops up and literally stops the progress of the medium through the printer. The printer grabs the leading edge of the paper and deskews it (i.e., squares it up). The registration assembly is responsible for ensuring that the paper travels straight into the fuser unit of the printer.

Fusing Toner to the Print Medium

The fuser unit of a laser printer heats the print medium and the toner on the medium as it passes through it. The typical operating temperature of a fuser unit is about 190° Celsius, but it may be adjusted. The goal of the fuser is to thoroughly melt the toner onto the medium. After it leaves the fuser unit, the toner should be firmly affixed to the medium.

To optimize performance, the fusing of the toner to the medium should occur as quickly and efficiently as possible. However, if the toner is not thoroughly melted onto the medium, the toner—which is typically in the form of an extraordinarily fine powder—tends to rub off easily.

Time and temperature play a vital role in fusing toner onto print media. If the time taken for the medium to pass through the fuser is too long, the medium can be damaged or the printed image might deteriorate. If the time is too short, the toner may not properly adhere to the medium. Similarly, if the temperature is too high, the medium can be damaged or the printed image might deteriorate. If the temperature is not high enough, the toner may not properly adhere to the medium.

Thickness Print Media

All materials have heat conductive properties. The most common print media, by far, is paper. However, paper is a fairly good insulator. It does not conduct heat extremely well. Thicker paper generally doesn't conduct heat as well as thinner paper.

As it passes through a fuser unit, thin paper transfers the heat quickly to the toner; therefore, the toner melts and adheres quickly. Thicker paper will transfer the heat slower; therefore, greater time or temperature is necessary for the toner to fully adhere.

Since heat transfer is slower with heavy paper, the following may be done to insure that the toner is sufficiently affixed to the paper: slow the paper down as it passes through the fuser unit and/or increase the temperature in the fuser unit.

The printing process can be tuned so the toner can be firmly affixed to the medium. Knowing the thickness of the medium gives a measure of heat conductivity, which can be used to tune the printing process. The speed of the paper in the paper path, and/or the temperature of the fuser can be adjusted so the toner is affixed and the medium is not damaged.

Conventional Approaches and Their Drawbacks

To expand their market appeal, printer manufacturers prefer that their printers are versatile and accommodate a wide variety of print media. For example, it is desirable for the printer to accommodate a range of print media from very thin, lightweight paper to very thick, heavy paper.

It is advantageous for the characteristics of the paper to be known before printing so that the printer can adjust accordingly. The typical objective is to get the toner to fully adhere to the medium.

To accommodate a range of print media thicknesses, printer manufacturers have taken three conventional approaches: Limited media thickness support, poor fusing performance, and/or manual fuser temperature control.

Limited Media Thickness Support

By specification, some manufacturers narrowly limit the range of media thickness, or media weight, supported by their printers. These printers have a configuration of temperature and media transfer speed that achieves optimal toner affixation with the specified, narrow, range of media thicknesses. Typically, this range includes the thickness of media most commonly employed. Thus, the specification limits the range of media thickness supported by the printer. For example, the specification may indicate that cardstock, a heavy, thick medium, is not supported for the printer.

In a traditional office environment, this narrow thickness range is sufficient for most applications. However, printers with this narrow media thickness specification have little or no appeal to markets where a wider variety of media is commonly used.

Poor Fusing Performance

Some manufacturers have expressly enlarged the range of supported thicknesses, but have done nothing to solve the problems discussed above. Although the manufacturers know that there is a problem with toner affixation with thick media, such media is still expressly supported. This approach does not solve the problems discussed above—rather, it simply ignores the problems.

Manual Fuser Temperature Control

In some instances, the users are given manual fuser temperature control to accommodate thicker or heavier print media. Such control may be via a control panel on the printer or via user interface on a computer. In response to the user's input about the media's thickness, the printer adjusts the temperature of the fuser unit or the speed at which the paper passes through the fuser unit.

Of course, like most manual controls, there is room for problems with this approach. Most users will not be aware of this existence of the manual control capability nor will they appreciate its importance. Moreover, there is a great chance of error. The user may erroneously specify a different thickness for the media than what is actually used. Someone else may change media, but the printer is still configured to print to a media of a different thickness.

Existing Need

Accordingly, there is a need for automatic determination of the thickness of a print medium so that the printing process may be adjusted automatically to achieve optimum results.

SUMMARY

Described herein is a technology for automatically determining the heat-conductive properties of print media. More particularly, described herein is a technology for indirectly and automatically determining the heat-conductive properties of print media by determining the stiffness of print media, such as acetate and paper.

At least one embodiment, described herein, includes a registration assembly of a laser printer. In this assembly, the print medium is deflected (i.e., bent, bowed, buckled, etc.). A measurement of such deflection is made. That measurement is an indication of the relative stiffness of the print medium. Assuming approximately similar densities, the stiffness of print media is directly related to its thickness. The thicker the medium the stiffer it is and vice versa. The thickness of print media is directly related to its heat conductivity.

By measuring the relative stiffness of a print medium, the toner fusing process may be adjusted based upon the relative heat conductive properties of the print medium. For example, the fuser temperature may be adjusted or the paper processing speed may be adjusted.

This summary itself is not intended to limit the scope of this patent. Moreover, the title of this patent is not intended to limit the scope of this patent. For a better understanding of the present invention, please see the following detailed description and appending claims, taken in conjunction with the accompanying drawings. The scope of the present invention is pointed out in the appending claims.

BRIEF DESCRIPTION OF THE DRAWINGS

The same numbers are used throughout the drawings to reference like elements and features.

DETAILED DESCRIPTION

Figure 1:
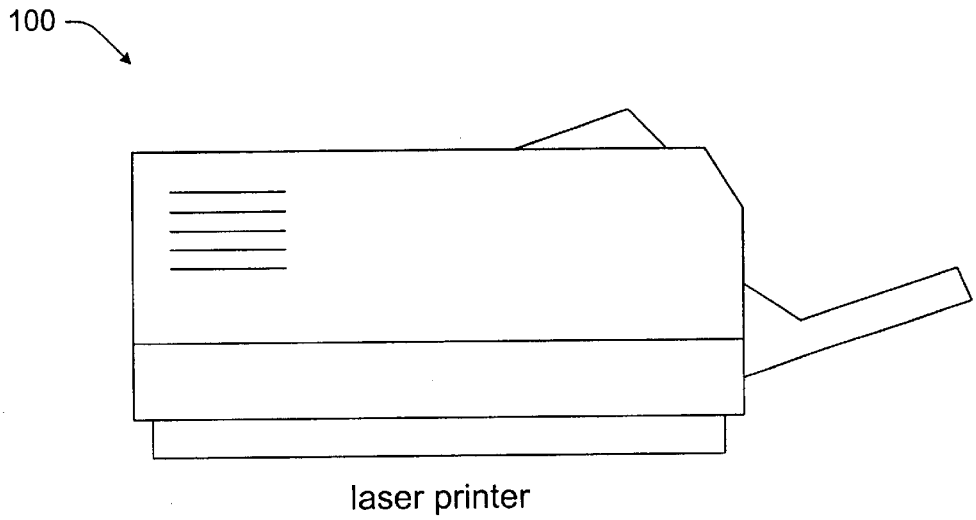
FIG. 1 is a simplified illustration of a typical laser printer which may be employed in accordance with an implementation of the invention herein.

In the following description, for purposes of explanation, specific numbers, materials and configurations are set forth in order to provide a thorough understanding of the present invention. However, it will be apparent to one skilled in the art that the present invention may be practiced without the specific exemplary details. In other instances, well-known features are omitted or simplified to clarify the description of the exemplary implementations of present invention, thereby better explain the present invention. Furthermore, for ease of understanding, certain method steps are delineated as separate steps; however, these separately delineated steps should not be construed as necessarily order dependent in their performance.

The following description sets forth one or more exemplary implementations of Automatically Determining Heat-Conductive Properties of Print Media. The inventors intend these exemplary implementations to be examples. The inventors do not intend these exemplary implementations to limit the scope of the claimed present invention. Rather, the inventors have contemplated that the claimed present invention might also be embodied and implemented in other ways, in conjunction with other present or future technologies.

An example of an embodiment of Automatically Determining Heat-Conductive Properties of Print Media may be referred to as an "exemplary heat-conductivity determiner."

Introduction

The one or more exemplary implementations, described herein, of the present claimed invention may be implemented (in whole or in part) by a media heat-conductivity determination system 200 and/or by a laser printer 100 (or other electrophotographic production device).

With at least one implementation of the exemplary heat-conductivity determiner, a registration assembly of a laser printer deflects (i.e., bends, bows, buckles, etc.) a print medium, such as a sheet of paper. A measurement related to such deflection is made. That measurement indicates the relative stiffness of the print medium. Assuming approximately similar densities, the stiffness of print media is directly related to its thickness. The thicker the medium the stiffer it is and vice versa. The thickness of print media is directly related to its heat conductivity.

By measuring the relative stiffness of a print medium, the toner fusing process may be adjusted based upon the relative heat conductive properties of the print medium. For example, the fuser temperature may be adjusted or the paper processing speed may be adjusted.

Stiffness as an Inferential Measurement of Thickness

To optimize the performance of the printer so that it can accommodate a wide range of different print media, the printer needs to know the heat conductivity properties of a print medium before it prints on it. This is before the image is put on the medium as it passes through the fuser unit to affix the toner.

However, it is not practical to directly measure heat conductivity of a print medium. As discussed above (in the Background section), the thickness of a print medium is directly related to its head conductivity. Commercially, thickness of print media is specified by the term "weight."

This stiffness of a print medium is an inferential (or indirect) indicator of the thickness of the medium. Thus, stiffness is an inferential indicator of the heat-conductivity of the medium.

The stiffness of a solid material is based upon its density and its thickness. A sheet material of high density and great thickness will be much stiffer than a similarly shaped material of low density and low thickness. If one assumes that print media has approximately the same density, then thickness determines stiffness of a medium. Therefore, stiffness is a good indicator of a print medium's thickness.

Those of ordinary skill in the art are generally aware of this relationship between stiffness, thickness, density, and heat conductivity of print media.

Exemplary Heat-Conductivity Determiner

Just before a laser printer (such as printer 100 of FIG. 1) prints onto a print medium, the medium stops at an internal portion of the printer called a registration assembly.

Figure 2:
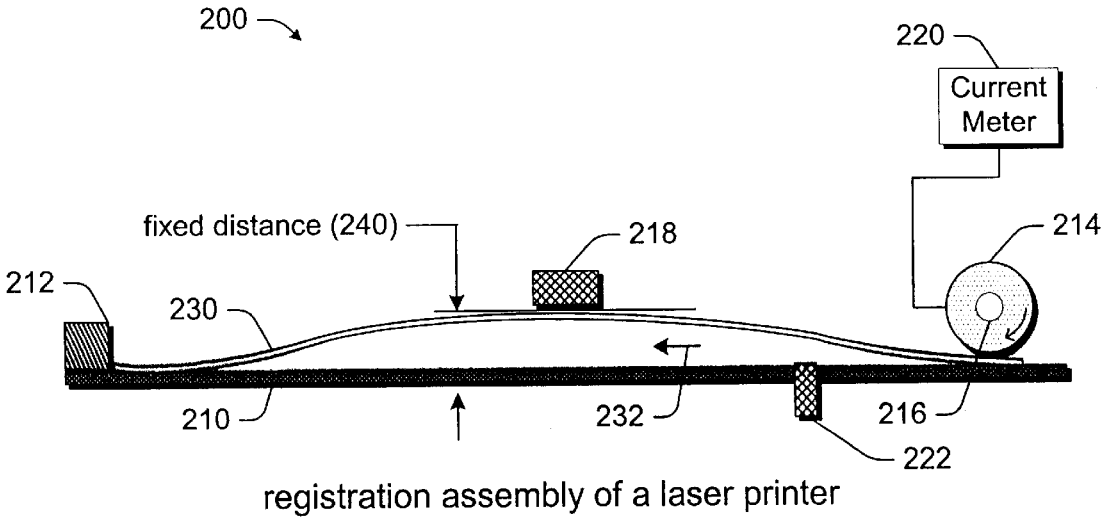
FIG. 2 is a diagram showing of a registration assembly in accordance with another implementation of the invention herein.

FIG. 2 shows the media heat-conductivity determination system 200. It includes a base 210, a stop 212, a drive motor 214, a rotary encoder 216, a proximity sensor 218, and a electrical current measuring subsystem 220 (alternatively, it may be called a current meter). The media heat-conductivity determination system 200 may also be called the registration assembly 200.

In the registration assembly, the printer grabs the leading edge of a print medium 230 (such as a sheet of paper), which is resting on the base 210, and deskews it (i.e., squares it up). In FIG. 2, the medium travels in the direction indicated by arrow 232.

Traditionally, the role of the registration assembly is to ensure that the medium travels straight into the fuser unit of the printer. To do this, the stop 212 pops up to impede the progress of the paper through the printer. Alternatively, the stop 212 is immobile. Deskewing mechanisms and rollers (not shown) deskew the medium. With the exemplary heat-conductivity determiner, the registration assembly may automatically determine the stiffness of the medium in addition to deskewing it.

While the assembly 200 holds the leading each of the medium, there is the drive motor and roller 214 positioned at the end of the medium opposite from the stop 212. After deskewing, the stop 212 moves out of the medium's path. This motor 214 is designed to drive the medium further along the print path However, if the stop 212 remains in place and the motor 214 turns (as indicated by the curved arrow on the motor), medium bends. This bending may also be called deflection, buckling, bowing, crooking, incurvation, inflection, arcuating, arching, and the like. The medium's resistance to the bending is a measure of its stiffness.

Depending upon how the stiffness measurement is accomplished, the registration assembly 200 may include a combination pair of the rotary encoder 216, the proximity sensor 218, and/or the electrical current measuring subsystem 220.

The rotary encoder 216 is a positioned on the shaft of the motor 214. It typically is a disk with a plurality of fine lines (etched on the disk). With its optical sensor, it counts the lines as the drive motor rotates. This way it measures how much the roller has turned.

The proximity sensor 218 (or position sensor) is positioned a fixed distance 240 from the base 210 on which the medium is resting in the registration assembly. Typically, it is positioned approximately at the point where the apex of the medium's deflection is expected. This proximity sensor may use contact or non-contact mechanisms to detect the position of the arched medium. Alternatively, it may measure the deflection distance rather than whether the medium has deflected a fixed distance.

The electrical current measuring subsystem 220 (or amp meter or circuitry to measure current) measures the current flowing to the motor 214. By doing so, the relatively amount of force used to deflect the medium 230 is measured.

In at least one embodiment of the exemplary heat-conductivity determiner, the drive motor 214 turns and arcuates the medium 230 until the medium contacts the sensor 218 or until the sensor determines that the medium has been bent a fixed distance 240. The stiffer the medium, the more force that the motor 214 must use to bend the medium the fixed distance.

Therefore, a relative measurement of the force used by the motor 214 to bend the medium 230 a fixed distance 240 gives a relative measurement of the medium's stiffness. The force may be measured by measuring how much current is used by the motor 214 to bend the medium. Thus, the indirect measurement of stiffness is the current used by the motor to bend the medium a fixed amount.

The electrical current measuring subsystem 220 measures the amount of current flowing to the motor 214 while it bends the medium. A signal from the position sensor 218 indicates when the current measurement is complete.

Alternatively, the motor 214 may have rotary encoder 216 so that the angle that the roller has turned while bending the medium is measured. In this embodiment, the motor 214 turns a fixed amount (e.g., 30 degrees) and the current is measured. This current measurement would be the measurement of the medium's stiffness. In this instance, there is no need for the position sensor.

The following are examples of combinations that may determine stiffness of the medium 230:

- with current meter 220 and position sensor 218, the motor 214 bends the medium 230 a fixed amount and current is measured;
- with current meter 220 and position sensor 218, the motor 214 receives a fixed amount of current to turn it and distance of deflection is measured;
- with current meter 220 and rotary encoder 216, the motor 214 turns a fixed amount and current is measured.

Other Types of Print Media

Other types of print media have characteristics that differ from that of paper. For example, acetate. It is transparent. Also, it requires a lower fuser temperature than paper; otherwise, the acetate will melt. Like paper, acetate will have variable thickness.

To determine if the print media is acetate, the printer may include an optical sensor 222 to determine if the media is transparent. This optical sensor may be in the registration assembly as shown in FIG. 2 or it may be located elsewhere in the paper path.

Figure 3:
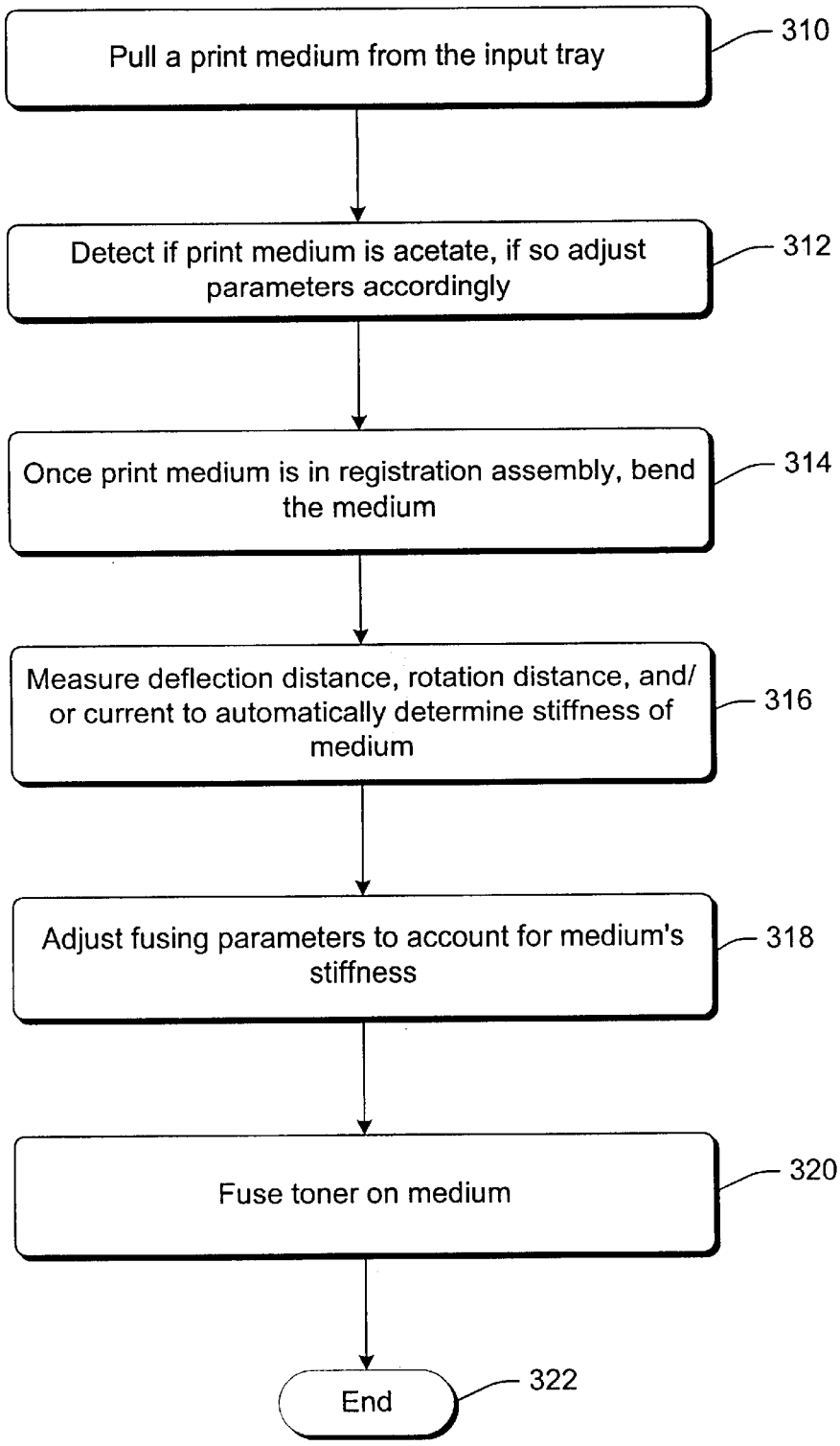
FIG. 3 is a flow chart illustrating a methodological implementation in accordance with an embodiment of the invention herein.

Methodological Implementation of the Exemplary Print Media Heat-Conductivity Determiner FIG. 3 shows methodological implementation of the exemplary heat-conductivity determiner performed by the media heat-conductivity determination system 200 (or some portion thereof).

At 310 of FIG. 3, the printer Pull a print medium from the input tray. At 312, the printer detects whether the medium is acetate. If so, it adjust parameters so that the acetate does not melt during fusing. At 314, media heat-conductivity determination system 200 deflects the medium while it is in the registration assembly. At 316, a measurement is made to determine the stiffness of the medium. The measurement may be of the deflection distance, rotation distance, and/or the current used. This measurement gives an inferential indication of the thickness of the medium. The fusing parameters are adjusted based upon these measurements. Typically, the temperature of the fusing unit will be increased for thick media and decreased for thin media.

At 320, the fusing unit fuses the toner onto the medium. At 322, the process end.

Exemplary Printer Architecture

Figure 4:
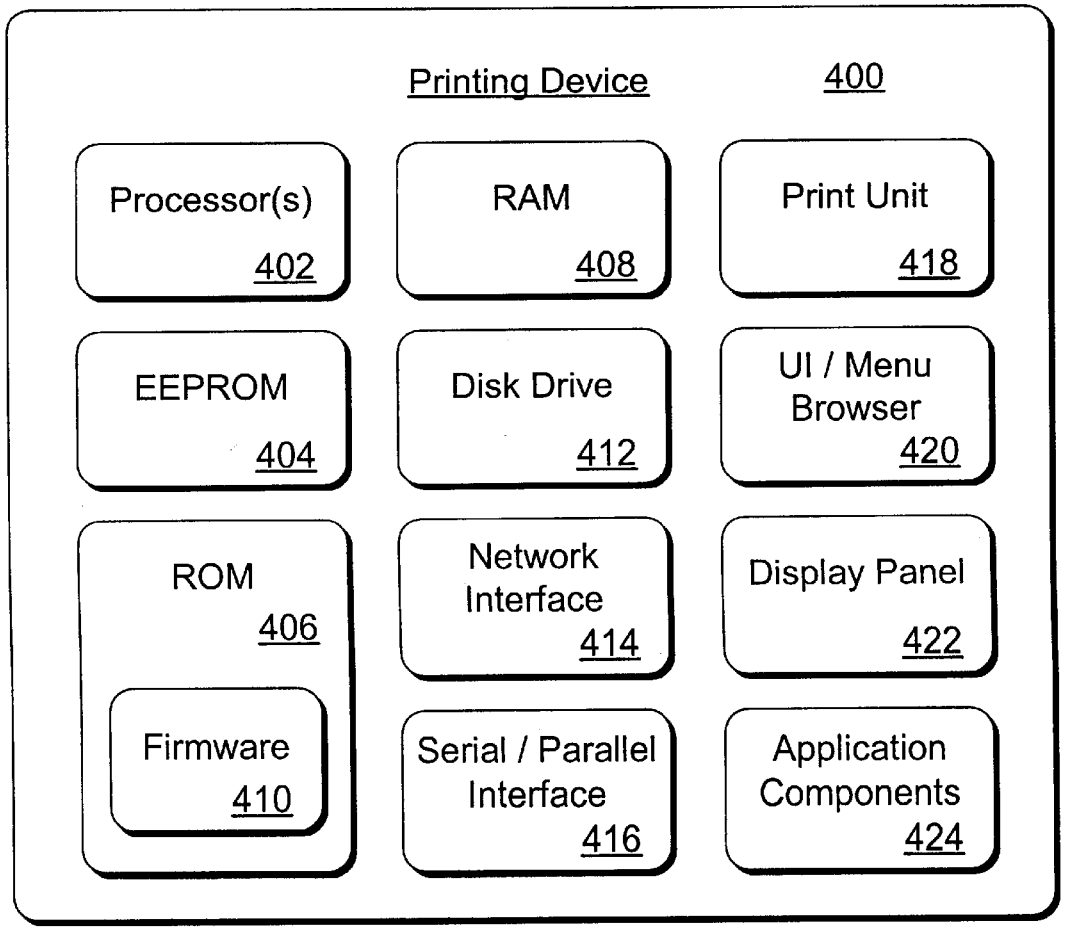
FIG. 4 is an example of a computing operating environment capable of implementing an implementation (wholly or partially) of the invention herein.

FIG. 4 illustrates various components of an exemplary printing device 100 that can be utilized to implement the inventive techniques described herein. Printer 400 includes one or more processors 402, an electrically erasable programmable read-only memory (EEPROM) 404, ROM 406 (non-erasable), and a random access memory (RAM) 408. Although printer 400 is illustrated having an EEPROM 404 and ROM 406, a particular printer may only include one of the memory components. Additionally, although not shown, a system bus typically connects the various components within the printing device 400.

The printer 400 also has a firmware component 410 that is implemented as a permanent memory module stored on ROM 406. The firmware 410 is programmed and tested like software, and is distributed with the printer 400. The firmware 410 can be implemented to coordinate operations of the hardware within printer 400 and contains programming constructs used to perform such operations.

Processor(s) 402 process various instructions to control the operation of the printer 400 and to communicate with other electronic and computing devices. The memory components, EEPROM 404, ROM 406, and RAM 408, store various information and/or data such as configuration information, fonts, templates, data being printed, and menu structure information. Although not shown, a particular printer can also include a flash memory device in place of or in addition to EEPROM 404 and ROM 406.

Printer 400 also includes a disk drive 412, a network interface 414, and a serial/parallel interface 416. Disk drive 412 provides additional storage for data being printed or other information maintained by the printer 400. Although printer 400 is illustrated having both RAM 408 and a disk drive 412, a particular printer may include either RAM 408 or disk drive 412, depending on the storage needs of the printer. For example, an inexpensive printer may include a small amount of RAM 408 and no disk drive 412, thereby reducing the manufacturing cost of the printer.

Network interface 414 provides a connection between printer 400 and a data communication network. The network interface 414 allows devices coupled to a common data communication network to send print jobs, menu data, and other information to printer 400 via the network. Similarly, serial/parallel interface 416 provides a data communication path directly between printer 400 and another electronic or computing device. Although printer 400 is illustrated having a network interface 414 and serial/parallel interface 416, a particular printer may only include one interface component. Printer 400 also includes a print unit 418 that includes mechanisms arranged to selectively apply the imaging material (e.g., liquid ink, toner, etc.) to a print media such as paper, plastic, fabric, and the like in accordance with print data corresponding to a print job. For example, print unit 418 can include a conventional laser printing mechanism that selectively causes toner to be applied to an intermediate surface of a drum or belt. The intermediate surface can then be brought within close proximity of a print media in a manner that causes the toner to be transferred to the print media in a controlled fashion. The toner on the print media can then be more permanently fixed to the print media, for example, by selectively applying thermal energy to the toner.

Print unit 418 can also be configured to support duplex printing, for example, by selectively flipping or turning the print media as required to print on both sides. Those skilled in the art will recognize that there are many different types of print units available, and that for the purposes of the present invention, print unit 418 can include any of these different types.

Printer 400 also includes a user interface and menu browser 420, and a display panel 422. The user interface and menu browser 420 allows a user of the printer 400 to navigate the printer's menu structure. User interface 420 can be indicators or a series of buttons, switches, or other selectable controls that are manipulated by a user of the printer. Display panel 422 is a graphical display that provides information regarding the status of the printer 400 and the current options available to a user through the menu structure.

Printer 400 can, and typically does include application components 424 that provide a runtime environment in which software applications or applets can run or execute. One exemplary runtime environment is a Java Virtual Machine (JVM). Those skilled in the art will recognize that there are many different types of runtime environments available. A runtime environment facilitates the extensibility of printer 400 by allowing various interfaces to be defined that, in turn, allow the application components 424 to interact with the printer.

Conclusion

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A system for automatically determining heat-conductive properties of print media, the system comprising:

a print media deflector configured to bow a print medium;

a stiffness measurer configured to measure the print medium's resistance to bowing by the deflector;

a heat-conductivity determiner configured to inferentially determine the heat-conductive properties of the print medium based upon the print medium's resistance to bowing by the deflector as measured by the stiffness measurer.

2. A system as recited in claim 1 further comprising toner fusing adjuster configured to adjust parameters related to fusing toner on the print medium based upon heat-conductive properties of the print medium determined by the heat-conductivity determiner.

3. A system as recited in claim 1, wherein the stiffness measurer comprises:

an electrical current measuring subsystem configured to measure the current extended to bow the medium;

position sensor configured to determine a distance that the medium deflects when bowed by the deflector.

4. A system as recited in claim 1 further comprising an optical sensor for determining if the print medium is transparent.

5. A printer comprising:

a fusing unit for fusing toner onto print media;

a system for automatically determining the heat-conductive properties of print media as recited in claim 1.

6. A system for automatically determining heat-conductive properties of print media, the system comprising:

a print media deflector configured to bow a print medium;

stiffness measurer configured to measure the print medium's resistance to bowing by the deflector;

wherein the print media deflector comprises:

a roller motor configured to push the medium when the roller motor turns;

a stop configured to impede the medium from traversing in at least one direction.

7. A system as recited in claim 6, wherein the stiffness measurer comprises:

an electrical current measuring subsystem configured to measure the current extended by the motor to bow the medium;

position sensor configured to determine when the medium bows a fixed amount.

8. A system as recited in claim 6, wherein the stiffness measurer comprises:

an electrical current measuring subsystem configured to measure the current required by the motor to bow the medium;

rotary encoder configured to determine the degree of rotation of the motor while the motor bows the medium.

9. A printer comprising:

a fusing unit for fusing toner onto print media;

a system for automatically determining heat-conductive properties of print media, wherein the system comprises:

a print media deflector configured to bow a print medium;

a stiffness measurer configured to measure the print medium's resistance to bowing by the deflector;

a heat-conductivity determiner configured to inferentially determine the heat-conductive properties of the print medium based upon the print medium's resistance to bowing by the deflector as measured by the stiffness measurer.

10. A printer as recited in claim 9, wherein the stiffness measurer comprises:

an electrical current measuring subsystem configured to measure the current extended to bow the medium;

position sensor configured to determine a distance that the medium deflects when by the deflector.

11. A printer as recited in claim 9, wherein the system comprises:

a roller motor configured to push the medium when the roller motor turns;

a stop configured to impede the medium from traversing in at least one direction.

12. A method for automatically determining heat-conductive properties of print media, the method comprising:

transporting a print medium through a printer;

bending the print medium;

determining the stiffness of the print medium;

inferentially determining the heat-conductive properties of the print medium based upon the determined stiffness of the print medium;

adjusting operation of a fusing unit of the printer to compensate for the heat-conductive properties of the print medium determined by the inferentially determining.

13. A method as recited in claim 12, wherein the determining the stiffness comprises measuring amount that the medium deflects.

14. A method as recited in claim 12, wherein the printer has drive rollers to push the medium when the rollers turn, the method further comprising turning the drive rollers to push the medium, wherein the stiffness of the medium is determined by measuring amount that the drive rollers turn.

15. A method as recited in claim 12, wherein the printer has drive rollers to push the medium when the rollers turn, the method further comprising turning the drive rollers to push the medium, wherein the stiffness of the medium is determined by measuring energy used to turn the drive rollers.

* * * * *